US005999096A

United States Patent [19]

Herbert

[11] Patent Number: 5,999,096

[45] Date of Patent: Dec. 7, 1999

[54] METERING APPARATUS WITH TAMPER DETECTOR

[75] Inventor: Raymond John Herbert, Leigh-on-Sea, United Kingdom

[73] Assignee: Neopost Limited, Essex, United Kingdom

[21] Appl. No.: 08/897,087

[22] Filed: Jul. 18, 1997

[30] Foreign Application Priority Data

Jul. 19, 1996 [GB] United Kingdom ..... 9615185

[51] Int. Cl.[6] ..... G08B 12/20

[52] U.S. Cl. ..... 340/544; 340/587

[58] Field of Search ..... 235/375; 340/544, 340/587

[56] References Cited

U.S. PATENT DOCUMENTS 4,692,743 9/1987 Holden et al. ..... 340/544

FOREIGN PATENT DOCUMENTS 945498 1/1964 United Kingdom .

2174830 11/1986 United Kingdom .

2182467 5/1987 United Kingdom .

2220513 1/1990 United Kingdom .

*Primary Examiner*—Harold I. Pitts

*Attorney, Agent, or Firm*—Shoemaker and Mattare, Ltd.

[57] ABSTRACT

Apparatus, for example postage metering apparatus is described as being provided with tamper detection means. The tamper detection means may comprise an electrically conductive or resistive first layer extending between a wall of a secure housing and components critical in the proper functioning of the apparatus. An indicator may include a second electrically conductive layer extending adjacent and electrically isolated from the first layer and means responsive to completion of an electrical path between the layers or means responsive to change in resistance of the resistive layer. In an alternative construction, the tamper detection means includes a sealed enclosed space containing gaseous substance at a pressure above ambient air pressure and means responsive to a decrease in the pressure in the space to permit a mechanical interposer to engage an operable mechanical element of the apparatus to inhibit operation thereof.

6 Claims, 1 Drawing Sheet

METERING APPARATUS WITH TAMPER DETECTOR

BACKGROUND OF THE INVENTION

This invention relates to metering apparatus such as postage meters provided with means to provide an indication of attempts at unauthorised tampering and to inhibit operation of the meter in the event of such unauthorised tampering.

Known postage meters include mechanisms for selectively applying power to a print drum to effect printing of a franking impression on a mail item. The postage meter also includes accounting means, usually electronic, for carrying out accounting functions in respect of an amount of credit available in the meter and postage charges to be applied to mail items. Briefly, the accounting means checks to ensure that there is sufficient credit available for a postage charge desired to be applied to a mail item and, provided the credit check is satisfactory, the accounting means trips the mechanism to enable power to be transmitted to rotate the print drum through one revolution only whereby a single franking impression is printed. Usually the mechanism includes a single revolution clutch which is tripped by the accounting means so as to transmit power and the clutch is so constructed that upon completion of a single revolution of the print drum the clutch is disengaged and transmission of power is terminated. A mechanical lock prevents rotation of the print drum when the mechanism has not been tripped by the accounting means. Thus rotation of the print drum to effect printing of a franking impression is controlled by the accounting means so that printing of a franking impression can be effected only when proper accounting for the postage charge has been effected.

In other postage meters currently being marketed, the printing is effected by digital printing devices, for example thermal transfer printers.

In order to prevent, or at least inhibit, unauthorised operation of the postage meter the accounting means and, in the case of mechanical printing devices, the mechanism for locking the print drum and for selectively transmitting power to the print drum or, in the case of electronic digital printers, the electronic drive to the printer are housed in a sealed secure housing. The housing is intended to prevent unauthorised access to those components of the postage meter which are critical in controlling operation of the postage meter in accounting for postage charges and for printing franking impressions on mail items indicative of postage charges for which accounting has been effected.

Generally access to the interior of the secure housing can be obtained only by breaking the seal of the housing and hence damage to the seal indicates that unauthorised tampering has taken place or has been attempted. However attempts may be made to obtain access to components of the meter within the secure housing by making an aperture through the wall of the housing and inserting a probe through the aperture. This aperture may be of such a small size that it is not easily visually detected and hence the tampering may not be detected.

SUMMARY OF THE INVENTION

According to one aspect of the invention apparatus housed in a secure housing includes intrusion detection means to detect unauthorised intrusion into the secure housing, said intrusion detection means including an element located within the secure housing in a location such as to be vulnerable to disturbance as a result of said unauthorised intrusion and indicator means operative in response to disturbance of said element to provide an indication of unauthorised intrusion.

According to a second aspect of the invention postage metering apparatus housed in a secure housing includes intrusion detection means to detect unauthorised intrusion into the secure housing, said intrusion detection means including an element located within the secure housing such as to be vulnerable to disturbance as a result of said unauthorised intrusion and indicator means operative in response to disturbance of said element to provide an indication of unauthorised intrusion.

The element of the intrusion detection means may be an element vulnerable to piercing and the indicator means is responsive to piercing of the element.

Preferably the intrusion detection means includes a first layer of electrically conductive material and the indicator means includes a second layer of electrically conductive material extending adjacent and electrically isolated from the first layer and circuit means connected between the first layer and the second layer responsive to completion of an electrically conductive path between the first layer and the second layer.

Alternatively the element of the intrusion detection means may include a resistive layer the electrical resistance of which layer is subject to variation in response to disturbance of the element.

The intrusion detection means may include a first layer in the form of a wall defining and enclosing a sealed space containing a gaseous substance and the indicator means is responsive to change in pressure of the gaseous substance within the space.

BRIEF DESCRIPTION OF THE DRAWING

Embodiments of the invention will now be described with reference to the drawings which.

DESCRIPTION OF THE PREFERRED EMBODIMENT

Figure 1:
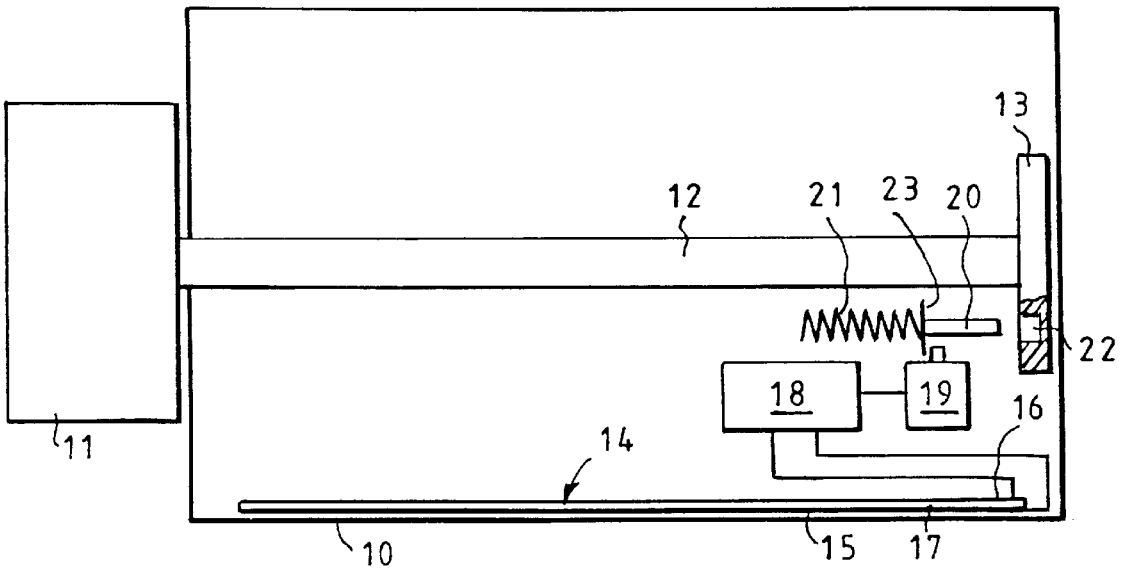
FIG. 1 shows diagrammatically a section through a secure housing of a postage meter including a first construction of intrusion detection means.

Referring to the drawing, components of a postage meter are housed in a sealed secure housing 10. A print drum 11 is supported on a shaft 12. The shaft extends from within the housing through a wall of the housing and the print drum is secured to the shaft, the print drum being located exterior to the housing. Mechanical power to rotate the print drum through a printing revolution is applied to the shaft through a single revolution clutch 13. The mechanical power is supplied by an electric motor (not shown) housed in a base of the franking machine through a mechanical coupling to the single revolution clutch 13.

Electronic circuits (not shown) for carrying out accounting and control functions also are housed in the sealed housing. The electronic circuits include non-volatile memory for storing accounting data. As is well known in postage meters, a required postage charge is input by means of a keyboard or other input means and the electronic circuits carry out a check to determine if there is a sufficient value of credit stored in the non-volatile memory of the circuits for the required postage charge. If the credit value is determined to be sufficient the electronic circuits operate an actuator to trip the one revolution clutch so that mechanical power is applied via the clutch to the shaft 12 to rotate the print drum 11 through a single revolution and the accounting data stored in the memory is modified to reflect the value of postage charge used. The one revolution clutch includes a mechanism whereby upon completion of one revolution, the clutch is disengaged and transmission of power to the shaft is terminated.

It will be appreciated that the clutch 13 is located within the secure housing 10 and hence access to the clutch is inhibited thereby impeding any attempt to trip the clutch, independently of the tripping of the clutch by the electronic circuits, to cause the print drum to rotate and print a franking impression on a mail item and for which franking impression no postage charge has been accounted for by the electronic circuits. Accordingly, in general, it is not possible to operate the postage meter to print a franking impression unless the postage charge relating to that impression has been properly accounted for by the electronic circuits.

However there is a possibility that a person desirous of using the postage meter in a fraudulent manner might attempt to insert a thin probe through the wall of the secure housing such as to operate the trip mechanism of the one-revolution clutch or to interfere with operation of a component of the postage meter to cause the postage meter to operate in a fraudulent manner and print a franking impression without carrying out proper accounting for the printed postage charge. For example this may be attempted by drilling a hole through the wall of the secure housing to permit insertion of a probe capable of engaging the trip mechanism to thereby trip the clutch 13 and thus transmit power to the print drum. The probe could be constructed in the form of a wire of relatively stiff material and hence the probe may be of small diameter. Consequently the diameter of the hole drilled through the wall of the secure housing may be sufficiently small as to be visually imperceptible. As a result fraudulent use of the postage meter could take place over a period of time before being detected.

In order to improve the security of the postage meter against such invasive access intrusion detection means is provided within the secure housing. In the embodiment illustrated in FIG. 1, the intrusion detection means includes a first layer 15 of electrically conductive material. The layer 15 extends and is located such as to provide a barrier between the wall of the secure housing 10 and components of the postage meter critical to the proper functioning of the postage meter. A second layer 16 of electrically conductive material extends adjacent the first layer 15 and is electrically isolated from the first layer 15 by means of an electrically insulating layer 17. The first and second layers preferably comprise a printed circuit board element 14 having an insulating substrate 17 and conductive layers 15, 16 on opposite faces of the substrate.

If a hole is drilled through the wall of the secure housing to gain unauthorised access to the interior of the secure housing, the element will be subjected to disturbance and it is likely that the element 14 will be pierced and whatever implement is used to drill the hole will complete an electrically conductive path between the first layer 15 and the second layer 16. Alternatively even if drilling of the hole does not result in piercing of the layer 15 and completion of an electrically conductive path to the second layer 16, the element 14 will act as a physical barrier to a probe inserted through the hole in the wall. The completion of the electrically conductive path between the conductive layers resulting from piercing of the element may be detected by an electrical circuit 18. The electrical circuit 18 may provide only an indication of the unauthorised intrusion. However it is preferred in addition or alternatively that the electrical circuit is operative in response to detection of the electrically conductive path between the first and second layers to inhibit further operation of the postage meter. The inhibition of operation of the postage meter may be effected electrically or may be effected, for example, by operation of an actuator 19 to permit an interposer 20, such as a pin or the like, to be urged by a spring 21 to engage in a bore 22 of the clutch 133. An indication of an unauthorised intrusion may be provided by the electrical circuit 18 setting a fault flag in a non-volatile memory.

Preferably the layer 15 of the element 14 extends in contact with or closely adjacent to the interior face of the wall of the secure housing 10 so that if a hole is drilled through the wall of the secure housing there is a high probability of piercing of the layer 15 and through the insulating layer to the second layer 16. Conveniently, the element 14 is formed of a so-called flexi-circuit in which the element is sufficiently flexible as to allow it to be formed to internal contours of the secure housing of the machine.

Instead of engaging in a bore 22 in the clutch 13, the interposer may engage with any other part of the postage meter driven by mechanical power transmitted by the clutch. When so engaged, the interposer 20 prevents transmission of mechanical power to cause rotation of the print drum. The spring 21 urges the interposer 20 into said engagement. Normally the interposer is held against the spring pressure and out of said engagement by the actuator 19. For example, a projection 23 on the interposer may engage against the actuator and when the actuator is operated by the electrical circuit the actuator no longer engages the projection and hence the interposer is free to move under the urging of the spring into engagement with the clutch.

Instead of the element 14 comprising first and second electrically conductive layers 15, 16 which are electrically isolated from one another by an electrically insulating layer 17, the element 1 may comprise a layer of electrically resistive material. When the element is subjected to disturbance such that displacement of a part of the element relative to other parts of the element occurs, the electrical resistance of the resistive layer will change and the indicator means is responsive to such change in resistance to provide an output indicative of an intrusion having occurred. Preferably the resistive layer is in the form of a track or tracks of resistive material extending between tow contacts to which the indicator means is connected. The or each track may comprise a plurality of sub-tracks extending substantially parallel to one another and connected together in series.

Instead of the multi-layer element 14 of electrically conductive layers, an element 24 in which the layers are in the form of a wall defining and enclosing a sealed gas-tight space may be provided. The space enclosed by the element is filled with a gaseous substance, which may be air, under a pressure slightly higher than ambient atmospheric pressure. The wall of the element 24 is such that if the wall is pierced and the pressure within the element decreases due to escape of the gaseous substance, the element collapses at least partially. The element extends and is located such as to provide a barrier to invasive access to components of the postage meter critical to the proper functioning of the postage meter. The sealed enclosed space within the element is filled with gaseous substance, which may be air, at a pressure in excess of ambient air pressure. Inflation of the element with the gaseous substance is effected during manufacture of the postage meter. This inflation may be after insertion of the element into the housing 10 or the element may be inflated prior to insertion in the housing 10.

If a hole is drilled through the wall of the secure housing, it is likely that the wall of the element 14 will be punctured and the element will deflate and at least partially collapse. Even if drilling of the hole through the wall of the secure housing does not result in piercing of the wall of the element 24, the element 24 will act as a physical barrier to any probe inserted through the hole in the wall of the housing. Deflation of the element is detected to provide an indication of an invasive intrusion of the secure housing and may inhibit further operation of the postage meter. If desired the wall of the element 24 may be provided with a resistive layer as described for the element 14 in the embodiment shown in FIG. 1 of the drawings. If pressure is applied to the wall of the element 24, the wall, even if not pierced will be subjected to disturbance and at least a part thereof will be displaced relative to other parts of the wall. This relative displacement will result in a change in resistance of the resistive layer and this change in resistance is detected by the indicator means.

Inhibition of operation of the postage meter may be effected mechanically by means of an interposer 20 as described hereinbefore. Normally the interposer is held against the spring pressure and out of engagement with the clutch by the inflated element 24. For example, the projection 23 on the interposer may engage against the element 24 and when the wall of the element is pierced and results in reduction in pressure within the element so that the element deflates, the projection and hence the interposer is free to move under the urging of the spring into engagement with the clutch.

In addition or alternatively, deflation of the element may be detected electrically. A diaphragm switch or microswitch may be provided and the switch be maintained in one state by the element when inflated. Upon deflation of the element, the switch is released to a second state. A detector circuit is connected to the switch to detect the state thereof. The detector, upon detection of the switch being in the second state, sets a fault mode flag in non-volatile memory. Instead of the interposer being mechanically maintained in a retracted position by the element 24 when inflated and released by deflation of the element, the interposer may be operated electro-mechanically by an actuator, as described hereinbefore with respect to FIG. 1, operated by the detector circuit.

The element 24 may be in the form of an air bag constructed by moulding a suitable synthetic plastic or rubber. The form of the element may be such that the element extends into major voids within the secure housing and preferably the wall of the element extends closely adjacent or in contact with those portions of the wall of the secure housing most vulnerable to invasive intrusion. The likelihood of puncturing of the bag by the drilling of a hole through the wall of the secure housing is increased when the wall of the element is in contact with the wall of the secure housing. If desired the wall of the element adjacent a part of the wall controlling the locking pin or the switch may be of decreased strength as compared with the remainder of the wall or may be of concertina form to increase sensitivity of operation of the locking pin or switch to deflation of the element.

It will be appreciated that the detection system for invasive intrusion operates in a fail-safe manner and deflation of the element for any reason will inhibit further operation of the postage meter. Continued operation of the postage meter will be possible after replacement of the deflated element with a new inflated element by an authorised service engineer permitted to unseal and reseal the secure housing.

Figure 2:
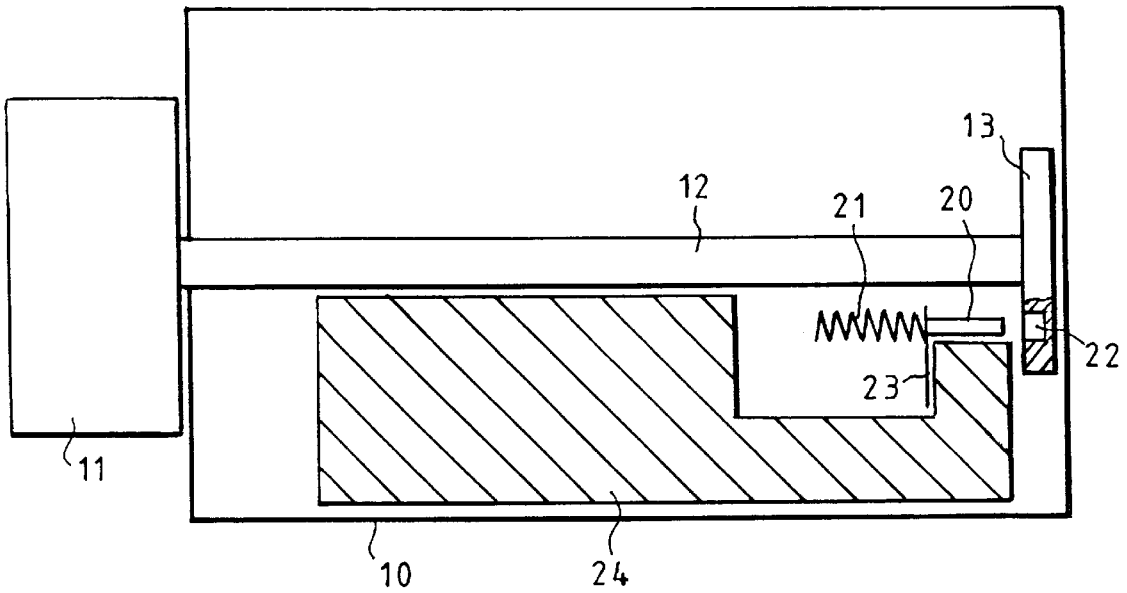
FIG. 2 shows diagrammatically a section through a secure housing of a postage meter including an alternative construction of intrusion detection means.

Since any attempt at fraudulent use may be made when the postage meter is not electrically powered, the detector circuit 18 of the embodiment shown in FIG. 1 and the detector circuit for detection of deflation of the element 24 of the embodiment shown in FIG. 2 are permanently powered. The detector circuit may be powered by the postage meter when the postage meter is powered and be powered by battery when the postage meter is not powered.

While the invasive intrusion detection system has been described hereinbefore in relation to inhibition of operation of mechanical components of a postage meter, the element 14 or the element 24 may be provided within a secure housing of an electronic postage meter in which printing is effected by a digital electronic printer, for example a thermal transfer printer, to provide an indication of attempts to tamper with electronic components and circuits and to inhibit further operation of those circuits of the postage meter. Furthermore while the system is particularly applicable to postage meters, it may be provided in other apparatus in which security is required to be maintained and attempts at intrusion to be detected.

I claim:

1. Metering apparatus including a secure housing; means for providing a metered output controlled by control means housed in said secure housing and intrusion detection means located in said secure housing and responsive to unauthorised intrusion into said secure housing; said intrusion detection means including an element maintained in a first position by gaseous pressure acting on said element and metering inhibition means maintained inoperative by said element wall when said element is maintained in said first position by said gaseous pressure; said metering inhibition means being rendered operative to prevent operation of said means for providing a metered output in response to said element being free to move away from said first position due to a reduction of said gaseous pressure acting on said element as a result of unauthorised intrusion into said secure housing.

2. Metering apparatus as claimed in claim 1 wherein the element comprises a flexible wall enclosing a space containing gas under the gaseous pressure; said gaseous pressure being greater than ambient air pressure and wherein the reduction of gaseous pressure occurs as a result of piercing of said flexible wall by unauthorised intrusion into the secure housing.

3. Metering apparatus as claimed in claim 1 wherein the means for producing a metered output includes an operable mechanical element and the metering inhibition means when rendered operative is operative to prevent operation of said mechanical element.

4. Metering apparatus as claimed in claim 1 wherein the means for producing a metered output includes printing means to print postal franking impressions.

5. Metering apparatus as claimed in claim 3 wherein the means for producing a metered output includes printing means to print postal franking impressions and the operable mechanical element comprises at least a part of a drive mechanism for said printing means.

6. Metering apparatus as claimed in claim 1 including electrical circuit means responsive to deflation of said flexible wall containing gas under gaseous pressure and said electrical circuit means being operative in response to deflation of said flexible wall to operate the metering inhibition means.

* * * * *